US009673004B1

(12) United States Patent
Ruempler et al.

(10) Patent No.: US 9,673,004 B1
(45) Date of Patent: Jun. 6, 2017

(54) ELECTRICAL SWITCHING APPARATUS, AND ARC CHAMBER ASSEMBLY AND ASSOCIATED CIRCUIT PROTECTION METHOD

(71) Applicant: EATON CORPORATION, Cleveland, OH (US)

(72) Inventors: Christian Ruempler, Wexford, PA (US); Paul Jason Rollmann, Menomonee Falls, WI (US); Xin Zhou, Wexford, PA (US)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 15/080,637

(22) Filed: Mar. 25, 2016

(51) Int. Cl.
*H01H 33/18* (2006.01)
*H01H 33/08* (2006.01)

(52) U.S. Cl.
CPC ..... *H01H 33/18* (2013.01); *H01H 33/08* (2013.01)

(58) Field of Classification Search
CPC ..... H01H 1/20; H01H 33/08; H01H 33/182; H01H 50/546; H01H 9/346; H01H 9/443; H01H 9/46
See application file for complete search history.

(56) References Cited

U.S. PATENT DOCUMENTS 2,945,109 A * 7/1960 Fehling ..... H01H 9/386 200/6 R
4,222,019 A * 9/1980 Rusch ..... H01H 71/528 335/202
4,656,446 A * 4/1987 Chien ..... H01H 1/2066 218/148
4,810,841 A * 3/1989 Wolf ..... H01H 1/2066 218/22
5,023,416 A * 6/1991 Oyama ..... H01H 1/22 200/244
5,138,122 A * 8/1992 Moldovan ..... H01H 9/34 218/22
6,700,466 B1 * 3/2004 Yamamoto ..... H01H 9/302 218/156
8,222,983 B2 * 7/2012 Zhou ..... H01H 9/34 218/150
8,368,492 B1 * 2/2013 Theisen ..... H01H 9/36 218/15
9,006,601 B2 4/2015 Zhou et al.
2008/0030289 A1 * 2/2008 Kralik ..... H01H 9/34 335/201

(Continued)

*Primary Examiner* — Truc Nguyen

(74) *Attorney, Agent, or Firm* — Eckert Seamans; John Powers; Grant Coffield

(57) ABSTRACT

An arc chamber assembly is for an electrical switching apparatus. The electrical switching apparatus includes a stationary contact and a movable contact structured to move into and out of engagement with the stationary contact in order to close and open the electrical switching apparatus, respectively. The arc chamber assembly comprises a plurality of splitter plates; a current loop member coupled to the plurality of splitter plates and being structured to extend from the stationary contact; an element coupled to the current loop member; and a number of permanent magnets each coupled to the element. The current loop member and the number of permanent magnets are structured to draw an electrical arc into the plurality of splitter plates.

17 Claims, 5 Drawing Sheets

(56) References Cited

U.S. PATENT DOCUMENTS

2014/0175057 A1* 6/2014 Gerving ..... H01H 33/182
218/26
2014/0360982 A1* 12/2014 Gerving ..... H01H 9/443
218/24

* cited by examiner

ELECTRICAL SWITCHING APPARATUS, AND ARC CHAMBER ASSEMBLY AND ASSOCIATED CIRCUIT PROTECTION METHOD

BACKGROUND

Field

The disclosed concept relates to electrical switching apparatus, such as, for example, circuit breakers and, more particularly, to circuit breakers employing arc chamber assemblies. The disclosed concept also relates to arc chamber assemblies for circuit breakers. The disclosed concept further relates to circuit protection methods.

Background Information

Electrical switching apparatus, such as circuit breakers, are employed in diverse capacities in power distribution systems. A circuit breaker may include, for example, a line conductor, a load conductor, a fixed contact and a movable contact, with the movable contact being movable into and out of electrically conductive engagement with the fixed contact. This switches the circuit breaker between an ON or closed position and an OFF or open position, or between the ON or closed position and a tripped or tripped OFF position. The fixed contact is electrically conductively engaged with one of the line and load conductors, and the movable contact is electrically conductively engaged with the other of the line and load conductors. The circuit breaker may also include an operating mechanism having a movable contact arm upon which the movable contact is disposed. Upon initial separation of the movable contact away from the stationary contact, an electrical arc is formed in the space between the contacts. The arc provides a means for smoothly transitioning from a closed circuit to an open circuit, but produces a number of challenges to the circuit breaker designer. Among them is the fact that the arc results in the undesirable flow of electrical current through the circuit breaker to the load. Additionally, the arc, which extends between the contacts, often results in vaporization or sublimation of the contact material itself. Therefore, it is desirable to extinguish any such arcs as soon as possible upon their propagation.

To facilitate this process, circuit breakers typically include arc chutes which are structured to attract, cool, and split the arcs. Specifically, each arc chute includes a plurality of spaced apart metallic or non-metallic splitter plates. As the movable contact is moved away from the stationary contact, the movable contact moves past the ends of the splitter plates, with the arc being drawn by magnetic and fluid-dynamic forces toward and between the splitter plates. The splitter plates are electrically insulated from one another such that the arc is quenched and split into several short arcs in series burning between the splitter plates, which generates a relatively high arc voltage until the arc is extinguished. In order to successfully interrupt a DC circuit, the circuit breaker needs to generate an arc voltage higher than the system voltage to stop the current flow. A challenge with interruption is that there is often not enough magnetic force to successfully draw the electrical arc into the arc chute. For example, many known arc chamber assemblies are able to draw the electrical arc towards the splitter plates at only relatively low current levels or relatively high current levels, but not at both low current levels and at high current levels.

There is thus room for improvement in electrical switching apparatus, and in arc chamber assemblies and in associated circuit protection methods.

SUMMARY

These needs and others are met by embodiments of the disclosed concept, which are directed to an electrical switching apparatus, and arc chamber assembly and circuit protection method.

As one aspect of the disclosed concept, an arc chamber assembly for an electrical switching apparatus is provided. The electrical switching apparatus includes a stationary contact and a movable contact structured to move into and out of engagement with the stationary contact in order to close and open the electrical switching apparatus, respectively. The arc chamber assembly comprises a plurality of splitter plates; a current loop member located adjacent the plurality of splitter plates and being structured to extend from the stationary contact; an element coupled to the current loop member; and a number of permanent magnets each coupled to the element. The current loop member and the number of permanent magnets are structured to draw an electrical arc into the plurality of splitter plates.

As another aspect of the disclosed concept, an electrical switching apparatus comprises at least one stationary contact; at least one movable contact structured to move into and out of engagement with the stationary contact in order to close and open the electrical switching apparatus, respectively; and at least one arc chamber assembly comprising a plurality of splitter plates, a current loop member located adjacent the plurality of splitter plates and extending from the stationary contact, an element coupled to the current loop member, and a number of permanent magnets each coupled to the element. The current loop member and the number of permanent magnets are structured to draw an electrical arc into the plurality of splitter plates.

As another aspect of the disclosed concept, a method of protecting a circuit with an electrical switching apparatus is provided. The electrical switching apparatus includes at least one stationary contact; at least one movable contact structured to move into and out of engagement with the stationary contact in order to close and open the electrical switching apparatus, respectively; and at least one arc chamber assembly comprising a plurality of splitter plates, a current loop member located adjacent the plurality of splitter plates and extending from the stationary contact, an element coupled to the current loop member, and a number of permanent magnets each coupled to the element. The method comprises the steps of engaging the movable contact with the stationary contact; causing an electrical current to flow between the movable contact and the stationary contact; moving the movable contact out of engagement with the stationary contact, thereby causing an electrical arc to form between the movable contact and the stationary contact; and drawing the electrical arc into the plurality of splitter plates with the current loop member and the number of permanent magnets.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts exert a force against one another either directly or through one or more intermediate parts or components.

As employed herein, the terms "U-shaped" shall mean that the shape of a corresponding structure has the general shape of the letter "U" in which the bottom of such letter or structure is rounded, generally round, square, generally square, or partially round and partially square, or has the general shape of a base member with two leg (or arm) members extending perpendicular or generally perpendicular from the ends of the base member.

Figure 1:
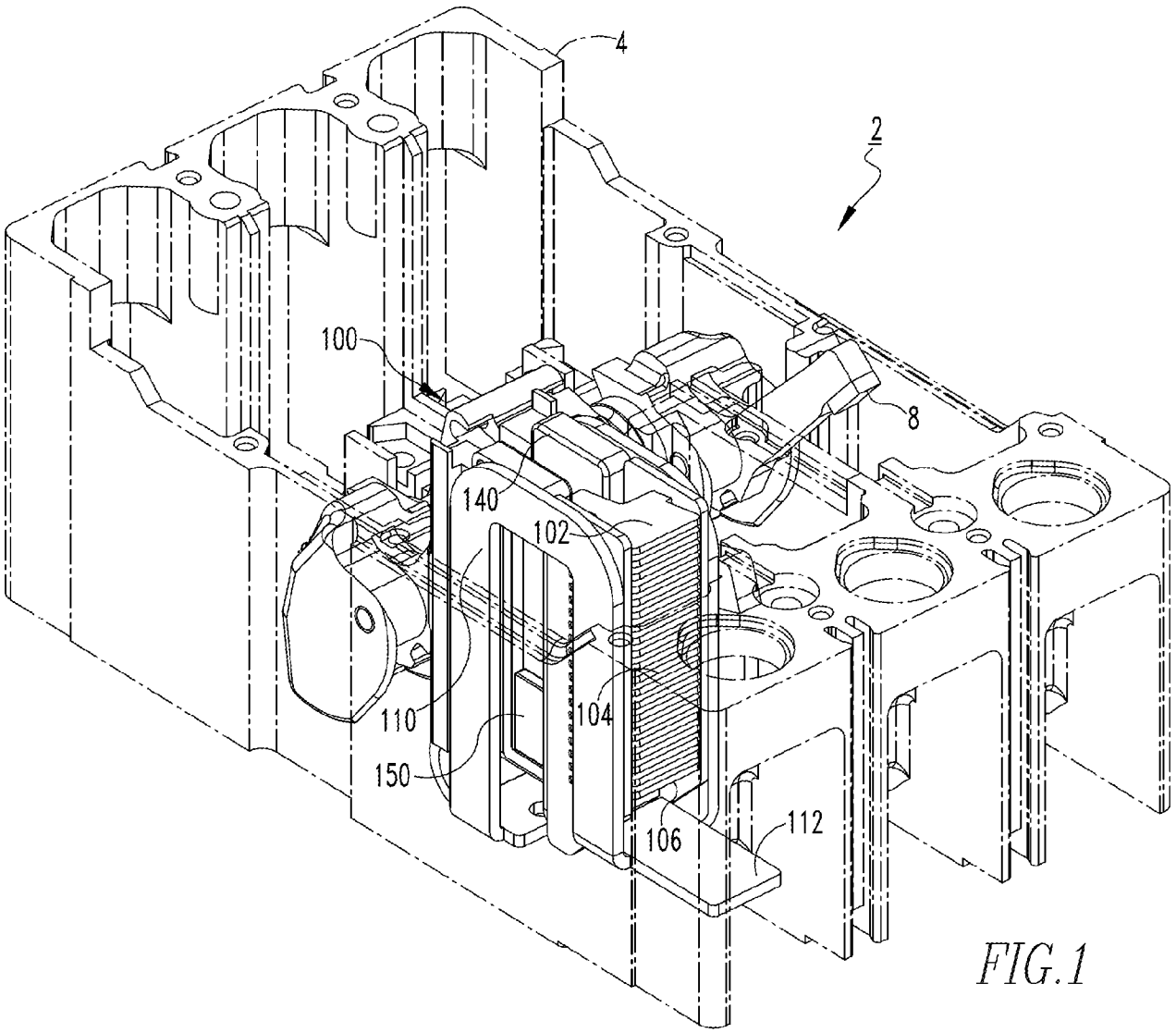
FIG. 1 is a front isometric view of a portion of an electrical switching apparatus and arc chamber assembly therefor, partially shown in phantom line drawing in order to see hidden structures, in accordance with a non-limiting embodiment of the disclosed concept.

FIG. 1 shows a portion of an electrical switching apparatus (e.g., without limitation, circuit breaker 2), in accordance with a non-limiting embodiment of the disclosed concept. The example circuit breaker 2 includes an insulative housing 4 (shown in simplified form in phantom line drawing), a number of stationary contacts (see, for example, stationary contact 6 shown in FIG. 5) for each of the poles of the circuit breaker 2, a number of movable contacts (one movable contact 8 is indicated in FIG. 1) each structured to move into and out of engagement with a corresponding one of the stationary contacts 6 in order to close and open the circuit breaker 2, respectively, and an arc chamber assembly 100 for a corresponding one of the poles of the circuit breaker 2. It will, however, be appreciated that any suitable alternative number of arc chamber assemblies may be employed, without departing from the scope of the disclosed concept. That is, a suitable alternative circuit breaker (not shown) may employ the arc chamber assembly 100, as well as one or two other arc chamber assemblies similar to the arc chamber assembly 100, for either or both of the other two poles of the circuit breaker. It is also within the scope of the disclosed concept to employ an arc chamber assembly similar to the arc chamber assembly 100 in a single pole circuit breaker (not shown). Furthermore, the arc chamber assembly 100 is located internal to the housing 4 and includes a plurality of splitter plates (three splitter plates 102,104,106 are indicated in FIG. 1).

When the movable contact 8 moves out of engagement with the stationary contact 6 (FIG. 5) during interruption, an electrical arc is formed in a space between the contacts 6,8. As will be discussed in greater detail herein below, the arc chamber assembly 100 provides a novel mechanism to successfully draw the electrical arc into the splitter plates 102,104,106 irrespective of the current level flowing through the contacts 6,8 and the direction of current flow. That is, at low current levels (i.e., generally less than 1,000 amperes) and at high current levels (i.e., generally greater than 1,000 amperes), the arc chamber assembly 100 advantageously draws the electrical arc into the splitter plates 102,104,106 in order to be broken up. This is distinct from prior art arc chamber assemblies (not shown) which often are only able to draw the electrical arc into the splitter plates at relatively low current levels or at relatively high current levels, but not at both low and high current levels.

Figure 2:
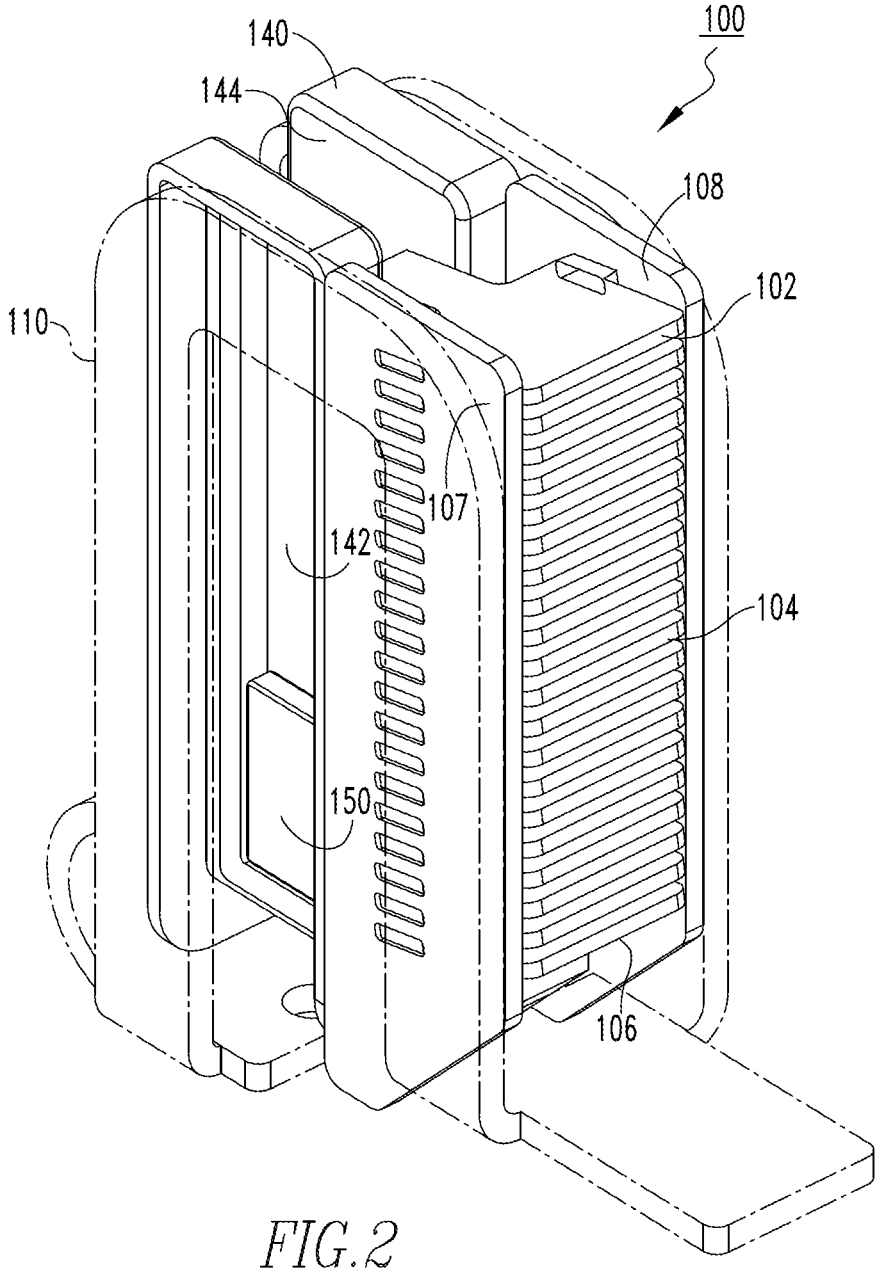
FIG. 2 is a front isometric view of the arc chamber assembly of FIG. 1, partially shown in phantom line drawing in order to see hidden structures.

Referring to FIG. 2, the arc chamber assembly 100 further includes a pair of opposing wall members 107,108 coupled to and being perpendicular to each of the splitter plates 102,104,106 in order to retain the splitter plates 102,104,106 in the arc chamber assembly 100. It will, however, be appreciated that a similar suitable alternative arc chamber assembly (not shown) could employ splitter plates and wall members having any suitable alternative configuration, without departing from the scope of the disclosed concept. Continuing to refer to FIG. 2, to successfully draw the electrical arc into the splitter plates 102,104,106 irrespective of the current level and the current flow direction, the arc chamber assembly 100 further includes a conductive current loop member 110 located adjacent the splitter plates 102, 104,106, an element (e.g., without limitation, U-shaped insulative member 140) coupled to the current loop member 110, and a number of permanent magnets 150,160 (shown in FIGS. 4 and 6) each coupled to the insulative member 140.

Figure 3:
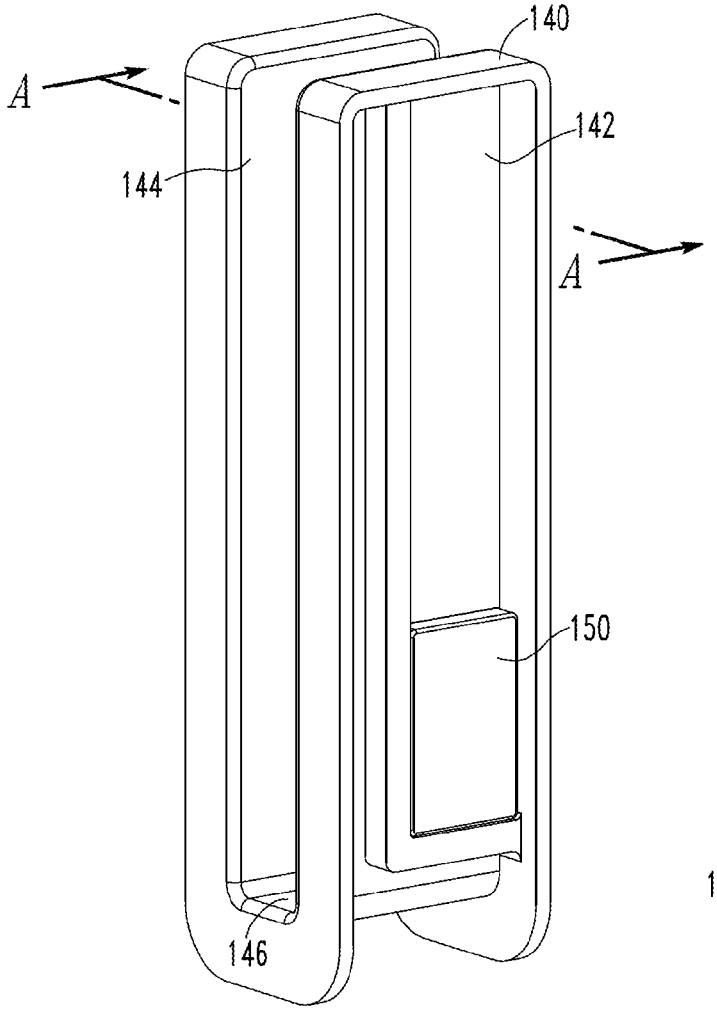
FIG. 3 is a front isometric view of an element and a number of permanent magnets for the arc chamber assembly of FIG. 2.
Figure 4:
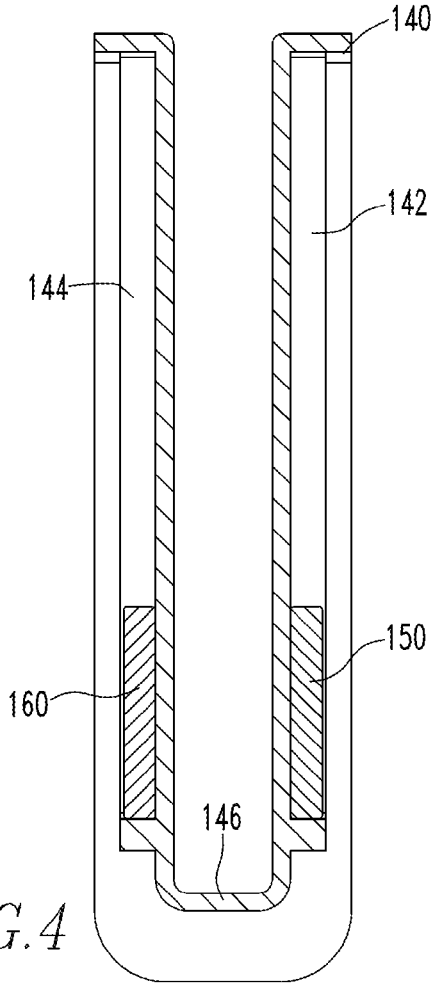
FIG. 4 is a section view of the element and the number of permanent magnets of FIG. 3, taken along line A-A of FIG. 3.

As shown in FIGS. 3 and 4, the insulative member 140 has parallel legs 142,144 and a middle portion 146 connecting the legs 142,144 together. In one example embodiment, the permanent magnets 150,160 are each coupled to a corresponding one of the legs 142,144 with a suitable adhesive such as, for example, glue. It will, however, be appreciated that the permanent magnets 150,160 may also be coupled to the legs 142,144, or to a suitable alternative insulative member (not shown), by any suitable alternative method (e.g., without limitation, overmolding). In another embodiment, an arc chamber assembly (not shown) may include additional permanent magnets, permanent magnets having different sizes, and/or permanent magnets in different configurations, without departing from the scope of the disclosed concept.

Figure 5:
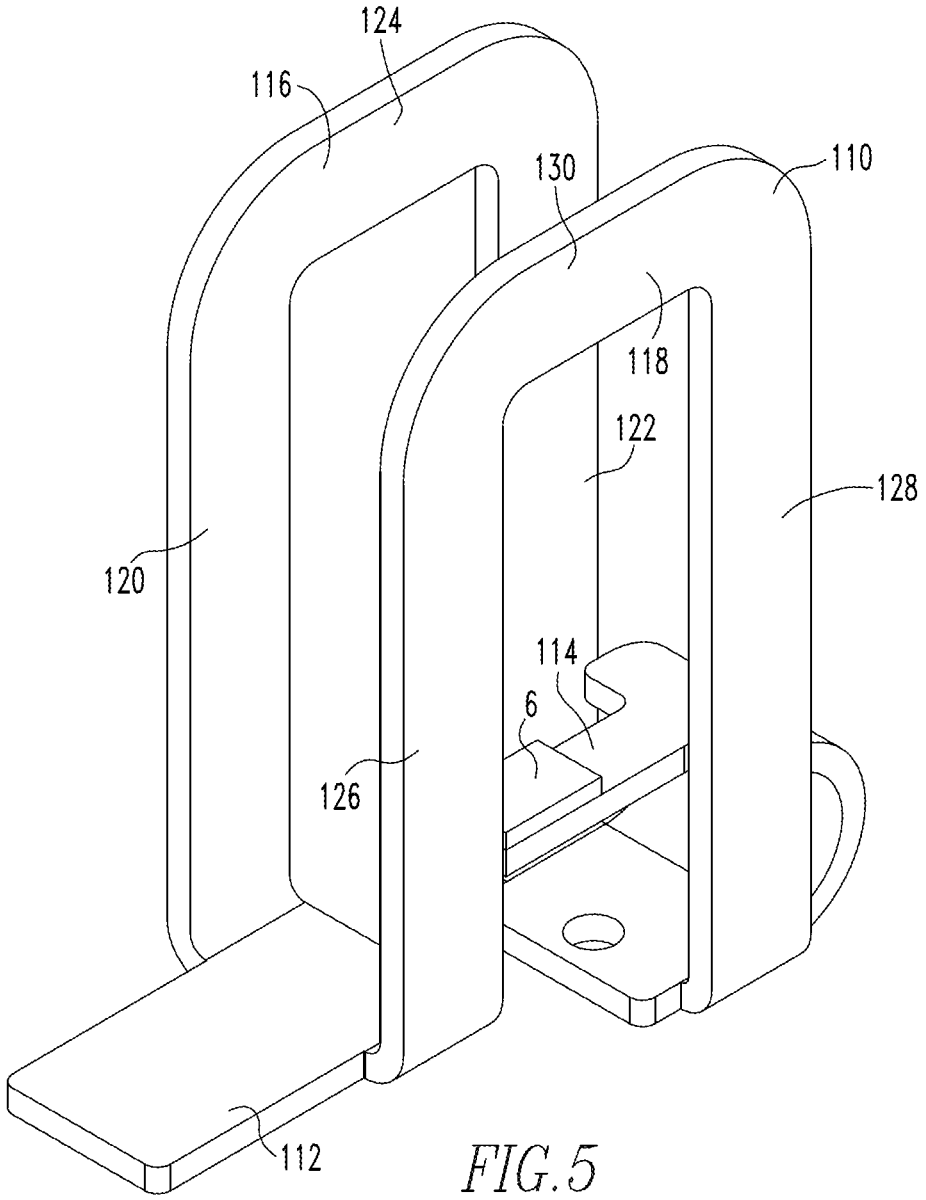
FIG. 5 is a front isometric view of a current loop member for the portion of the arc chamber assembly of FIG. 2, and shown with a stationary contact.

FIG. 5 shows the current loop member 110, which extends from and is couple to one of the stationary contacts 6. The current loop member 110 has a pair of opposing end portions 112,114, and a pair of loop portions 116,118 extending from proximate the first end portion 112 to proximate the second end portion 114 and connecting the end portions 112,114 together. In other words, the end portions 112,114 are separated by the loop portions 116,118. In one example embodiment, the current loop member 110 is a single unitary component made of a single piece of material. The loop portions 116,118 each have respective parallel legs 120,122, 126,128 and respective middle portions 124,130 connecting the respective parallel legs 120,122,126,128. Furthermore, the stationary contact 6 is coupled to the second end portion 114 by any suitable mechanism such as, for example, welding. It will thus be appreciated that when the circuit breaker 2 (FIG. 1) is connected to a live source, electrical current flows between the first end portion 112 (i.e., a terminal end portion) and the second end portion 114. As such, electrical current is split between the first loop portion 116 and the second loop portion 118, thus generating a magnetic field oriented parallel to respective front edge portions of the splitter plates 102,104,106 (FIGS. 1 and 2).

Figure 6:
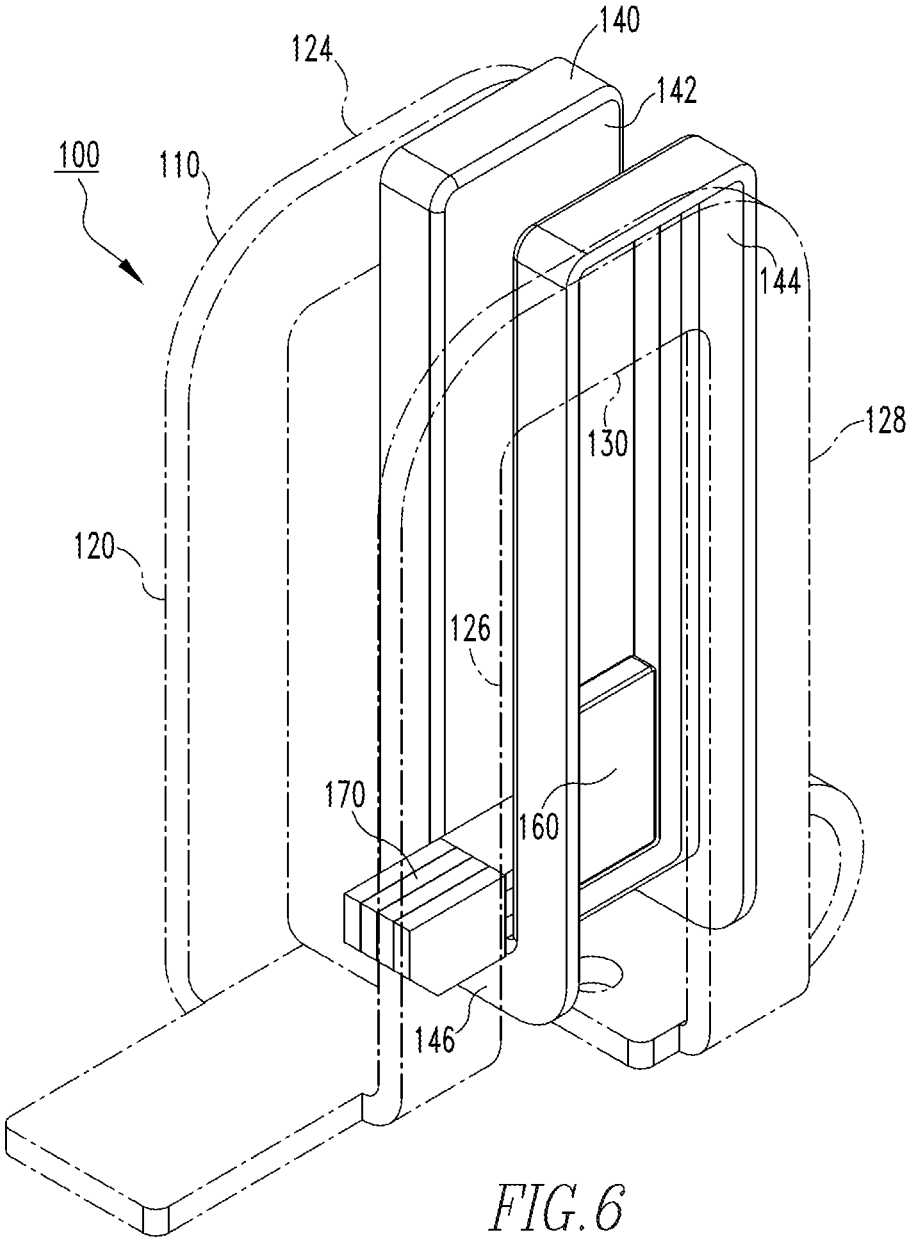
FIG. 6 is a front isometric view of a portion of the arc chamber assembly of FIG. 2, and partially shown in phantom line drawing in order to see hidden structures.

FIG. 6 shows a portion of the arc chamber assembly 100, which further includes an arc runner 170 coupled to the second end portion 114 of the current loop member 110. As shown, the middle portion 146 of the insulative member 140 is coupled to the second end portion 114 (FIG. 5) of the current loop member 110, and the second end portion 114 is located between the legs 142,144 of the insulative member 140. Stated differently, the middle portion 146 is looped around the second end portion 114. The instant configuration reliably retains the insulative member 140 and the permanent magnets 150,160 in the arc chamber assembly 100. Furthermore, the splitter plates 102,104,106 (FIGS. 1 and 2), the insulative member 140, and the permanent magnets 150,160 are located between the loop portions 116,118 and as a result are reliably retained in the arc chamber assembly 100. Additionally, the middle portion 146 is opposite the middle portions 124,130, and the legs 120,122 (FIG. 5),126, 128,142,144 are all parallel to one another in order to provide a reliable mechanism to draw the electrical arc into the splitter plates 102,104,106 (FIGS. 1 and 2) irrespective of current level and current flow direction.

More specifically, the current loop member 110 and the permanent magnets 150,160 are structured to direct the electrical arc into the splitter plates 102,104,106. First, the permanent magnets 150,160 generate a relatively constant magnetic field that exerts a force on the electrical arc to draw the electrical arc into the splitter plates 102,104,106. Second, as current flows through the current loop member 110 (i.e., through each of the loop portions 116,118), a magnetic field is generated that is oriented parallel to the respective front edge portions of the splitter plates 102,104,106. The force of the magnetic field generated by current flow through the current loop member 110 depends on the current level. For example, higher current flow causes a relatively strong magnetic field to be generated whereas lower current flow causes a relatively weak magnetic field to be generated. Thus, at relatively low current levels (i.e., less than 1,000 amperes), the force of the magnetic field generated by the permanent magnets 150,160 on the electrical arc is generally greater than the force of the magnetic field of the current loop member 110 on the electrical arc. Because the magnetic field generated by the permanent magnets 150,160 is relatively constant, the electrical arc will advantageously be drawn into the splitter plates 102,104,106 at low current levels by the permanent magnets 150,160.

As the current level increases, the current flow through the current loop member 110 (i.e., through each of the loop portions 116,118) generates a stronger magnetic field that is oriented parallel to the respective front edge portions of the splitter plates 102,104,106 and that is able to draw the electrical arc into the splitter plates 102,104,106. That is, the magnetic field generated by the current loop member 110 at relatively high current levels (i.e., greater than 1,000 amperes) generally exerts a greater force on the electrical arc than the permanent magnets 150,160, which might not otherwise be able to draw the electrical arc into the splitter plates 102,104,106 in isolation. In this manner, the combination of the current loop member 110 and the permanent magnets 150,160 is able to successfully draw the electrical arc into the splitter plates 102,104,106 at low levels as well as at high levels. This is distinct from many known prior art circuit breakers (not shown) which often only have mechanisms that are able to draw the electrical arc into the splitter plates at either high current levels or low current levels.

Furthermore, it will be understood that the combination of the insulative member 140 and the permanent magnets 150,160 is not a slot motor. That is, the arc chamber assembly 100 is devoid of U-shaped laminations (not shown). This allows the integrity of the magnetic field generated by the current loop member 110 to be maintained. Also, the disclosed configuration (i.e., splitter plates 102, 104,106 being located between the loop portions 116,118) advantageously generates a relatively large magnetic field, in terms of volume, that draws the electrical arc into the splitter plates 102,104,106, thereby increasing the arc voltage and enhancing interruption performance. Arc chamber assemblies (not shown) including slot motors, by way of comparison, have magnetic fields that are undesirably limited to the space inside the slot motor and the narrow surrounding region.

It follows that a method of protecting a circuit with the circuit breaker 2 includes the steps of engaging the movable contact 8 with the stationary contact 6, causing an electrical current to flow between the movable contact 8 and the stationary contact 6, moving the movable contact 8 out of engagement with the stationary contact 6, thereby causing an electrical arc to form between the movable contact 8 and the stationary contact 6, and drawing the electrical arc into the splitter plates 102,104,106 with the current loop member 110 and the permanent magnets 150,160.

Accordingly, it will be appreciated that the disclosed concept provides for an improved (e.g., without limitation, more reliable in terms of interrupting both high and low current levels) electrical switching apparatus 2, and arc chamber assembly 100 and protecting method therefor, in which a current loop member 110 and a number of permanent magnets 150,160 are structured to draw an electrical arc into a plurality of splitter plates 102,104,106.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An arc chamber assembly for an electrical switching apparatus, said electrical switching apparatus comprising a stationary contact and a movable contact structured to move into and out of engagement with said stationary contact in order to close and open said electrical switching apparatus, respectively, said arc chamber assembly comprising:

a plurality of splitter plates;

a current loop member disposed adjacent said plurality of splitter plates and being structured to extend from said stationary contact;

an element coupled to said current loop member; and a number of permanent magnets each coupled to said element, wherein said current loop member and said number of permanent magnets are structured to draw an electrical arc into said plurality of splitter plates; wherein said number of permanent magnets comprises a first permanent magnet and a second permanent magnet; wherein said element comprises a first leg, a second leg, and a middle portion connecting said first leg and said second leg; wherein said first permanent magnet is coupled to said first leg; and wherein said second permanent magnet is coupled to said second leg.

2. The arc chamber assembly of claim 1 wherein said element is a U-shaped insulative member.

3. The arc chamber assembly of claim 1 being devoid of U -shaped laminations.

4. An arc chamber assembly for an electrical switching apparatus, said electrical switching apparatus comprising a stationary contact and a movable contact structured to move into and out of engagement with said stationary contact in order to close and open said electrical switching apparatus, respectively, said arc chamber assembly comprising:

a plurality of splitter plates;

a current loop member disposed adjacent said plurality of splitter plates and being structured to extend from stationary contact;

an element coupled to said current loop member; and a number of permanent magnets each coupled to said element, wherein said current loop member and said number of permanent magnets are structured to draw an electrical arc into said plurality of splitter plates; wherein said current loop member comprises a first end portion, a second end portion, a first loop portion, and a second loop portion; wherein the first loop portion and the second loop portion each extend from proximate the first end portion to proximate the second end portion; and wherein said plurality of splitter plates, said element, and said number of permanent magnets are disposed between said first loop portion and said second loop portion.

5. The arc chamber assembly of claim 4 wherein said element comprises a first leg, a second leg, and a middle portion connecting said first leg and said second leg; wherein the first loop portion comprises a first leg, a second leg, and a middle portion connecting the first leg of the first loop portion to the second leg of the first loop portion; wherein the second loop portion comprises a first leg, a second leg, and a middle portion connecting the first leg of the second loop portion to the second leg of the second loop portion; and wherein the middle portion of said element is disposed opposite and distal the middle portion of the first loop portion and the middle portion of the second loop portion.

6. The arc chamber assembly of claim 5 wherein the first leg and the second leg of the first loop portion, and the first leg and the second leg of the second loop portion are disposed parallel to the first leg and the second leg of said element.

7. An electrical switching apparatus comprising:

at least one stationary contact;

at least one movable contact structured to move into and out of engagement with said at least one stationary contact in order to close and open said electrical switching apparatus, respectively; and at least one arc chamber assembly comprising:

a plurality of splitter plates, a current loop member disposed adjacent said plurality of splitter plates and extending from said stationary contact, an element coupled to said current loop member, and a number of permanent magnets each coupled to said element, wherein said current loop member and said number of permanent magnets are structures to draw an electrical arc into said plurality of splitter plates; wherein said current loop member comprises a first end portion, a second end portion, a first loop portion, and a second loop portion; wherein the first loop portion and the second loop portion each extend from proximate the first end portion to proximate the second end portion; and wherein said plurality of splitter plates, said element, and said number of permanent magnets are disposed between said first loop portion and said second loop portion.

8. The electrical switching apparatus of claim 7 wherein said number of permanent magnets comprises a first permanent magnet and a second permanent magnet; wherein said element comprises a first leg, a second leg, and a middle portion connecting said first leg and said second leg; wherein said first permanent magnet is coupled to said first leg; and wherein said second permanent magnet is coupled to said second leg.

9. The electrical switching apparatus of claim 8 wherein said element is a U-shaped insulative member.

10. The electrical switching apparatus of claim 7 wherein said at least one arc chamber assembly is devoid of U-shaped laminations.

11. The electrical switching apparatus of claim 7 wherein said at least one stationary contact is a plurality of stationary contacts; wherein said at least one movable contact is a plurality of movable contacts; wherein said at least one arc chamber assembly is a plurality of arc chamber assemblies; and wherein said electrical switching apparatus is a circuit breaker.

12. The electrical switching apparatus of claim 7 wherein said element comprises a first leg, a second leg, and a middle portion connecting said first leg and said second leg; wherein the first loop portion comprises a first leg, a second leg, and a middle portion connecting the first leg of the first loop portion to the second leg of the first loop portion; wherein the second loop portion comprises a first leg, a second leg, and a middle portion connecting the first leg of the second loop portion to the second leg of the second loop portion; and wherein the middle portion of said element is disposed opposite and distal the middle portion of the first loop portion and the middle portion of the second loop portion.

13. The electrical switching apparatus of claim 12 wherein the first leg and the second leg of the first loop portion, and the first leg and the second leg of the second loop portion are disposed parallel to the first leg and the second leg of said element.

14. A method of protecting a circuit with an electrical switching apparatus comprising at least one stationary contact; at least one movable contact structured to move into and out of engagement with said at least one stationary contact in order to close and open said electrical switching apparatus, respectively; and at least one arc chamber assembly comprising a plurality of splitter plates, a current loop member disposed adjacent said plurality of splitter plates and extending from said stationary contact, an element coupled to said current loop member, and a number of permanent magnets each coupled to said element, the method comprising the steps of:

engaging said at least one movable contact with said at least one stationary contact;

causing an electrical current to flow between said at least one movable contact and said at least one stationary contact;

moving said at least one movable contact out of engagement with said at least one stationary contact, thereby causing an electrical arc to form between said at least one movable contact and said at least one stationary contact; and drawing the electrical arc into said plurality of splitter plates with said current loop member and said number of permanent magnets, wherein said current loop member comprises a first end portion, a second end portion, a first loop portion, and a second loop portion; wherein the first loop portion and the second loop portion each extend from proximate the first end portion to proximate the second end portion; and wherein said plurality of splitter plates, said element, and said number of permanent magnets are disposed between said first loop portion and said second loop portion.

15. The method of claim 14 wherein said number of permanent magnets comprises a first permanent magnet and a second permanent magnet; wherein said element comprises a first leg, a second leg, and a middle portion connecting said first leg and said second leg; wherein said first permanent magnet is coupled to said first leg; and wherein said second permanent magnet is coupled to said second leg.

16. The method of claim 14 wherein said element comprises a first leg, a second leg, and a middle portion connecting said first leg and said second leg; wherein the first loop portion comprises a first leg, a second leg, and a middle portion connecting the first leg of the first loop portion to the second leg of the first loop portion; wherein the second loop portion comprises a first leg, a second leg, and a middle portion connecting the first leg of the second loop portion to the second leg of the second loop portion; and wherein the middle portion of said element is disposed opposite and distal the middle portion of the first loop portion and the middle portion of the second loop portion.

17. The method of claim 14 wherein said at least one arc chamber assembly is devoid of U-shaped laminations.

* * * * *